US007325369B2

(12) United States Patent
Jalbert

(10) Patent No.: US 7,325,369 B2
(45) Date of Patent: Feb. 5, 2008

(54) APPARATUS INCLUDING A DIFFERENTIAL FOR ROTATING A CAP RELATIVELY TO A CONTAINER

(76) Inventor: Luc Jalbert, 3517. rue Balzac, Boisbriand, Quebec (CA) J7H 1P4

( * ) Notice: Subject to any disclaimer, the term of this patent is extended or adjusted under 35 U.S.C. 154(b) by 13 days.

(21) Appl. No.: 11/357,012

(22) Filed: Feb. 21, 2006

(65) Prior Publication Data

US 2007/0193226 A1 Aug. 23, 2007

(51) Int. Cl.
*B67B 3/20* (2006.01)
*B67B 3/26* (2006.01)
*B67B 3/28* (2006.01)

(52) U.S. Cl. ..... 53/75; 53/317; 53/331.5

(58) Field of Classification Search ..... 53/75, 53/490, 317, 331.5

See application file for complete search history.

(56) References Cited

U.S. PATENT DOCUMENTS 1,664,514 A * 4/1928 Kramer ..... 53/317
2,876,605 A * 3/1959 McElroy et al. ..... 53/317
2,942,394 A * 6/1960 Bjering et al. ..... 53/317
3,280,534 A 10/1966 Hildebrandt et al.
3,845,605 A 11/1974 Hartness
3,905,177 A * 9/1975 Herzog ..... 53/317
4,199,914 A 4/1980 Ochs et al.
4,569,181 A * 2/1986 Raudat ..... 53/251
4,608,806 A * 9/1986 Haslam et al. ..... 53/317
5,423,159 A * 6/1995 Bankuty et al. ..... 53/317
5,669,209 A 9/1997 Dewees et al.
5,858,141 A * 1/1999 Repp et al. ..... 156/69
5,918,442 A 7/1999 Dewees et al.
6,023,910 A 2/2000 Lubus et al.
6,732,487 B2 5/2004 Bouraoui et al.

FOREIGN PATENT DOCUMENTS

DE 4132695 A1 * 4/1993

* cited by examiner

*Primary Examiner*—Stephen F. Gerrity

(57) ABSTRACT

An apparatus for rotating a cap relatively to a container. The container moves along a predetermined path at a container speed. The cap has a first and a second cap engagement location. The first and second cap engagement locations are circumferentially spaced apart relative to each other. The apparatus includes a first cap engaging component, the first cap engaging component including a first component cap engaging surface for engaging the cap at the first cap engagement location and applying a first substantially tangential force thereto. The first cap engaging surface moves at a first speed when substantially in register with the first cap engagement location. A second cap engaging component includes a second component cap engaging surface for engaging the cap at the second cap engagement location and applying a second substantially tangential force thereto. The second cap engaging surface moves at a second speed when substantially in register with the second cap engagement location. The first and second cap engaging components are operatively coupled to each other for maintaining substantially constant the sum of the first and second speed.

15 Claims, 6 Drawing Sheets

APPARATUS INCLUDING A DIFFERENTIAL FOR ROTATING A CAP RELATIVELY TO A CONTAINER

FIELD OF THE INVENTION

The present invention relates generally to automated manufacturing lines. More specifically, the present invention is concerned with an apparatus and a method for rotating a cap relatively to a container.

BACKGROUND OF THE INVENTION

There exist many apparatuses for rotating caps relatively to a container. For example, such apparatuses are used for screwing caps onto containers or screwing off caps from containers.

Some of these apparatuses include discs that rotate in opposing directions. For example, U.S. Pat. No. 5,918,442 issued to Dewees on Jul. 6, 1999, describes such an apparatus. In these apparatuses, a container is moved toward the discs and the cap is positioned over the container. When the cap reaches the discs, the discs engage the cap and rotate the discs relatively to the container.

Since there is typically a need to rotate the cap by a relatively large angle, the discs must rotate relatively fast because the duration of the engagement between the discs and the cap is relatively short. This causes the discs to wear relatively fast. In addition, having discs that rotate at a relatively high speed tends to destabilize the container when the cap is engaged as an impact produced onto the cap by the discs is then transmitted to the container. Furthermore, when a cap is screwed onto a container, the discs typically do not allow adjusting relatively precisely a torque applied to the cap.

In another type of device used for screwing caps onto containers, two belts are used to apply forces onto opposite sides of a cap. An example of such a device is found in U.S. Pat. No. 3,280,534 issued to Hildebrandt et al. on Jan. 4, 1963. Once again, achieving a relatively precise torque when screwing the cap is relatively hard to achieve using these types of devices. Also, the speed of the belt is usually fixed. Therefore, it is relatively hard to select belt speeds that are suitable for both rotating the cap relatively fast when the cap is initially screwed onto the container and producing a relatively slow rotation of the cap when the cap is almost entirely screwed onto the container.

Indeed, as the cap is screwed onto the container, a torque applied by the rotating cap onto the container increases. At one point, the cap will slide relatively to the belts because typically, the force that is applied onto the cap is smaller than a force applied onto the container that resists rotation. A slipping belt wears off prematurely, may damage the cap and may destabilize the container.

Against this background, there exists a need in the industry to provide a novel apparatus and method for rotating a cap relatively to a container.

OBJECTS OF THE INVENTION

An object of the present invention is therefore to provide an improved method and apparatus for rotating a cap relatively to a container.

SUMMARY OF THE INVENTION

In a first broad aspect, the invention provides an apparatus for rotating a cap relatively to a container. The container moves along a predetermined path at a container speed. The cap has a first and a second cap engagement location. The first and second cap engagement locations are circumferentially spaced apart relative to each other. The apparatus includes a first cap engaging component, the first cap engaging component including a first component cap engaging surface for engaging the cap at the first cap engagement location and applying a first substantially tangential force thereto. The first cap engaging surface moves at a first speed when substantially in register with the first cap engagement location. A second cap engaging component includes a second component cap engaging surface for engaging the cap at the second cap engagement location and applying a second substantially tangential force thereto. The second cap engaging surface moves at a second speed when substantially in register with the second cap engagement location. The first and second cap engaging components are operatively coupled to each other for maintaining substantially constant the sum of the first and second speed.

Advantageously, the claimed invention may use cap engaging components having engaging surfaces that move at relatively low speeds. Therefore, this reduces the wear of the belts as a difference between the speed of a cap that is engaged and the belt is relatively small.

In some embodiments of the invention, the first and second cap engagement locations are substantially diametrically opposed relative to each other. In these cases, in some embodiments, the sum of the first and second speeds is about twice the container speed, which causes caps that have a rotational symmetry to experience forces that move the center of these caps at an average speed that is equal to the container speed. Advantageously, the forces exerted onto the cap and the container when the belts start engaging the cap are then minimized.

In addition, while the sum of the first and second speeds is constant, each of these speeds may individually vary for the duration over which the cap is engaged. This allows rotation of the cap to be relatively fast at the beginning of the engagement and to have the first and second speeds substantially equal at the end of the engagement. Therefore, when a cap is completely screwed onto a bottle, there is no rotation of the cap relatively to the container and the cap and the container therefore only have a translational motion.

In some embodiments of the invention, the sum of the first and second speeds is maintained by having a differential interconnecting the first and second cap engaging components. In other embodiments of the invention, this relationship is maintained with the use of speed measuring devices and motors that are interconnected with the controller that maintain the above mentioned relationship.

In another broad aspect, the invention provides a method for rotating a cap relatively to a container, the container moving along a predetermined path at a container speed. The cap has a first and a second cap engagement location, the first and second cap engagement locations being circumferentially spaced apart relatively to each other. The method includes:

engaging the cap at the first cap engagement location and applying a first substantially tangential force thereto to move the first cap engagement location at a first speed;

engaging the cap at the second cap engagement location and applying a second substantially tangential force thereto to move the second cap engagement location at a second speed; and maintaining substantially constant the sum of the first and second speeds while the cap is engaged at the first and second cap engagement locations.

Other objects, advantages and features of the present invention will become more apparent upon reading of the following non-restrictive description of preferred embodiments thereof, given by way of example only with reference to the accompanying drawings.

DETAILED DESCRIPTION

Figure 1A:
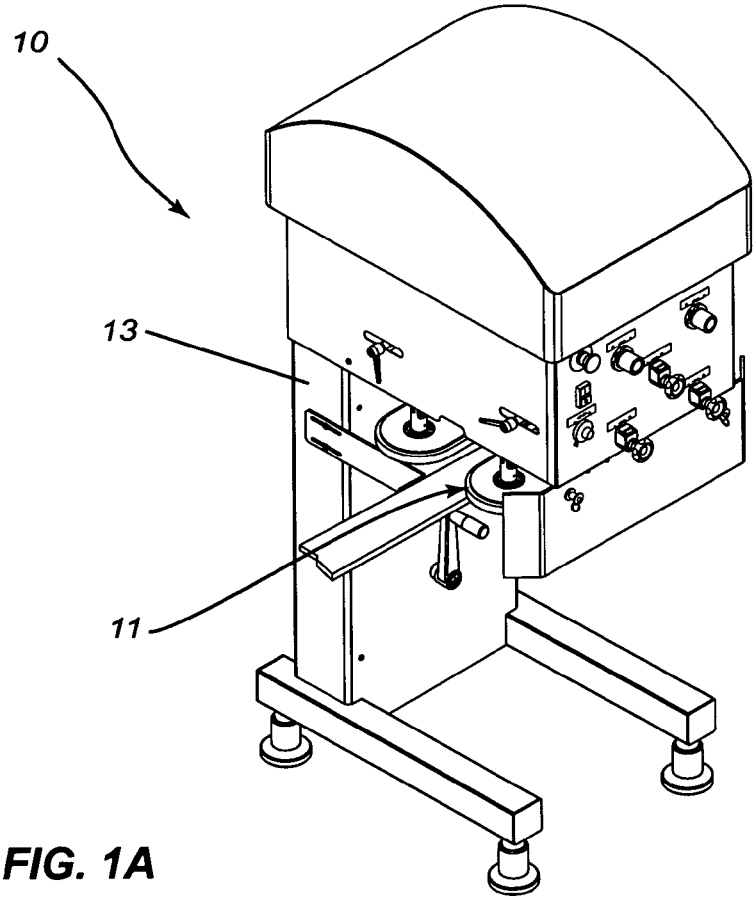
FIG. 1A, in a perspective view, illustrates an apparatus for rotating a cap relatively to a container in accordance with an embodiment of the present invention.
Figure 1B:
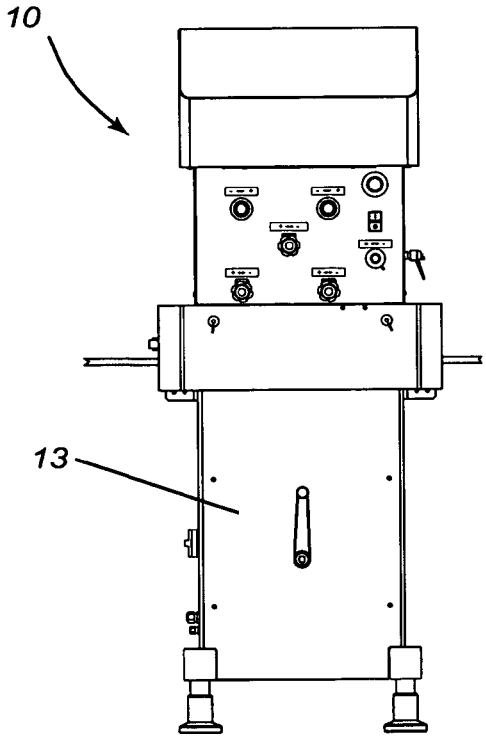
FIG. 1B, in a front elevation view, illustrates the apparatus of FIG. 1.
Figure 1C:
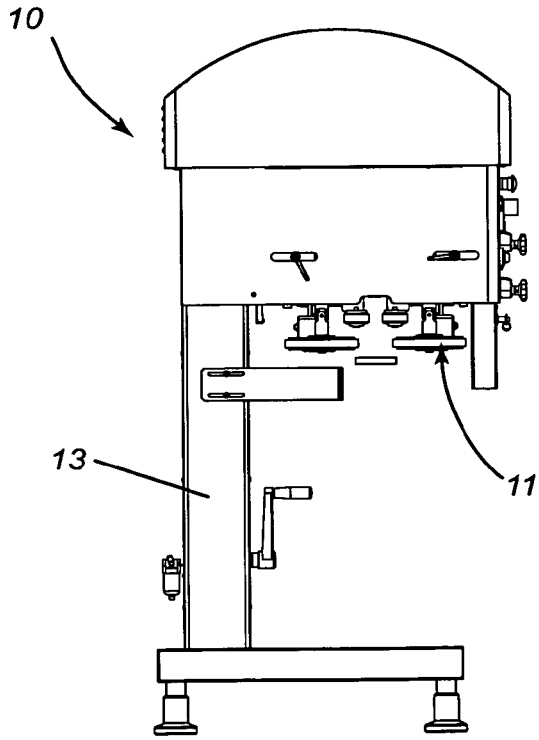
FIG. 1C, in a side elevation view, illustrates the apparatus of FIG. 1.

FIGS. 1A, 1B and 1C illustrates an apparatus 10 for rotating a cap 12 (not shown in FIGS. 1A, 1B and 1C) relatively to a container 14 (not shown in FIGS. 1A, 1B and 1C). The apparatus 10 includes a cap screwing assembly 11 mounted to a frame 13. In some embodiments of the invention, the frame 13 allows for the adjustment of a height above a ground surface at which the cap screwing assembly 11 is located.

Figure 2:
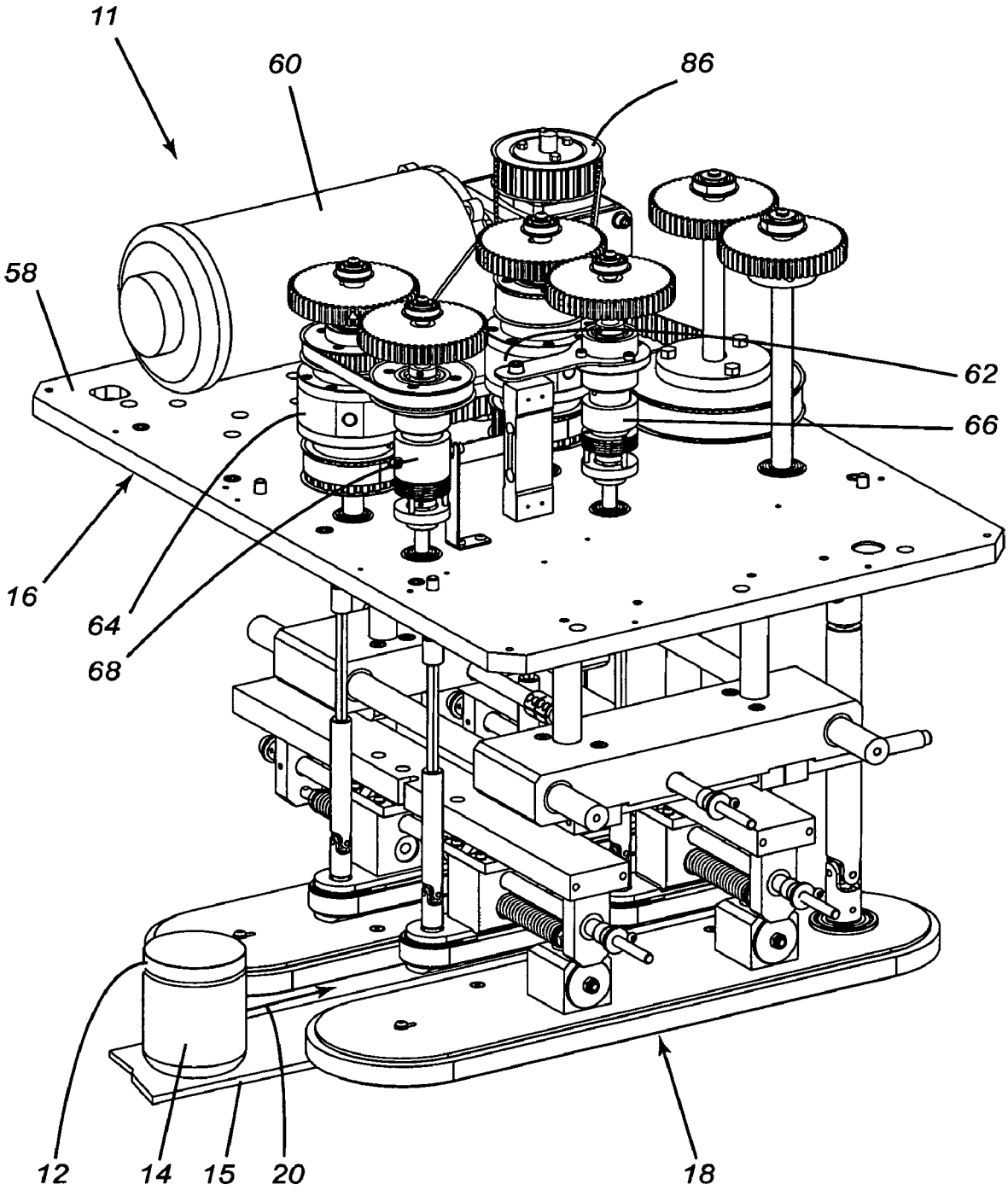
FIG. 2, in a perspective view, illustrates a cap screwing assembly of the apparatus of FIG. 1, the cap screwing assembly including a driven stage and a driving stage.

Referring to FIG. 2, the container 14 moves along a predetermined path at a container speed generally indicated by the reference numeral 20. For example, as seen in the drawings, the container 14 moves onto a sliding rail 15 that defines the predetermined path and supports the container 14. However, it is within the scope of the invention to support the container in any other suitable manner.

The cap screwing assembly includes a driving stage 16 and a driven stage 18. The driving stage 16 is coupled to the driven stage 18 so that power is provided to components of the driven stage 18 that engage the cap 12 and the container 14 to move the cap 12 and the container 14 through the apparatus 10 and to rotate the cap 12 relatively to the container 14.

The cap 12 is shown in FIG. 2 in a partially screwed state. The apparatus 10 is used to completely screw the cap 12 onto the container 14 by rotating the cap 12 relatively to the container 14. However, it is within the scope of the invention to have an apparatus similar to the apparatus 10 that removes caps from containers. Also, the cap 12 and the container 14 are shown as being substantially respectively disc-shaped and cylindrical. However, apparatuses that may handle caps and containers having any other suitable shape are also within the scope of the invention.

Referring to 3B, the cap 12 has a first and a second cap engagement location 22 and 24. The first and second cap engagement locations 22 and 24 are circumferentially spaced apart relatively to each other. For example, as shown in FIG. 3B, the first and second cap engagement locations 22 and 24 are substantially diametrically opposed relatively to each other. However, in alternative embodiments of the invention, the first and second cap engagement locations 22 and 24 are positioned at any other suitable circumferential location.

Figure 3A:
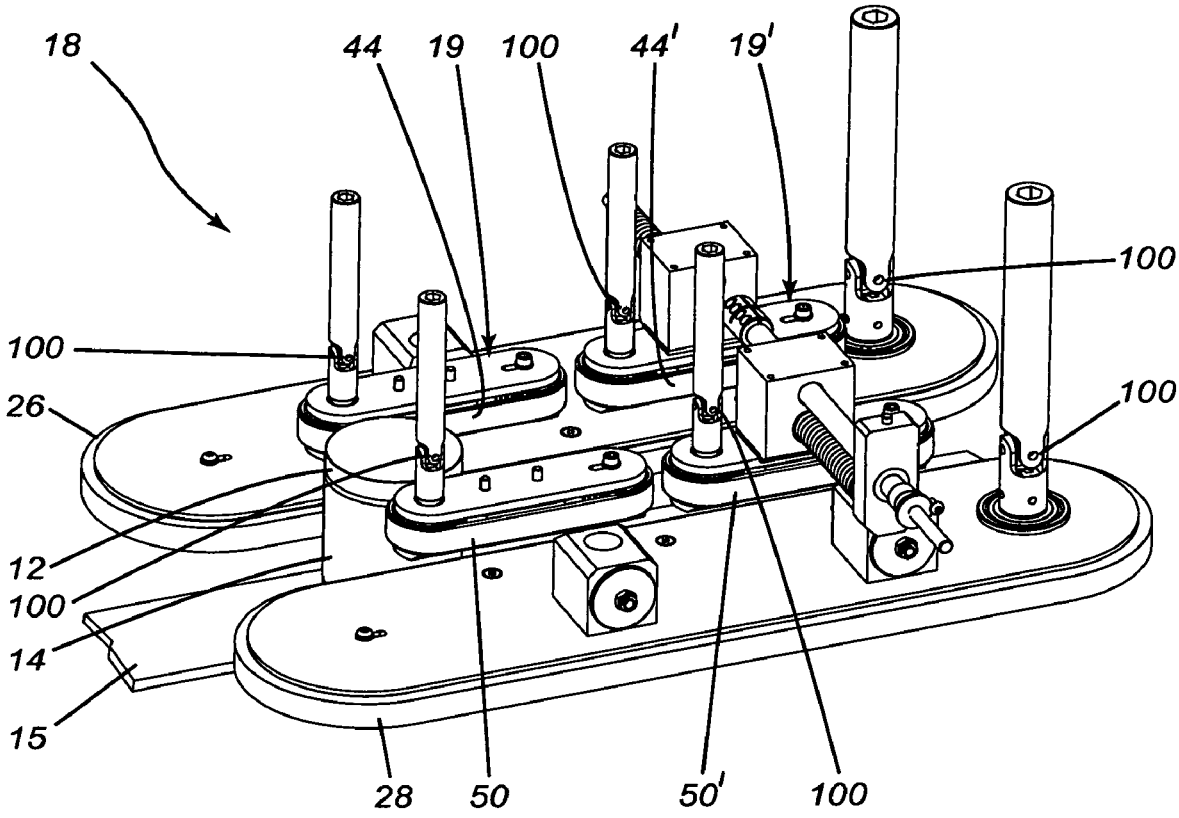
FIG. 3A, in a partial perspective view, illustrates the driven stage of the cap screwing assembly of FIG. 1.
Figure 3B:
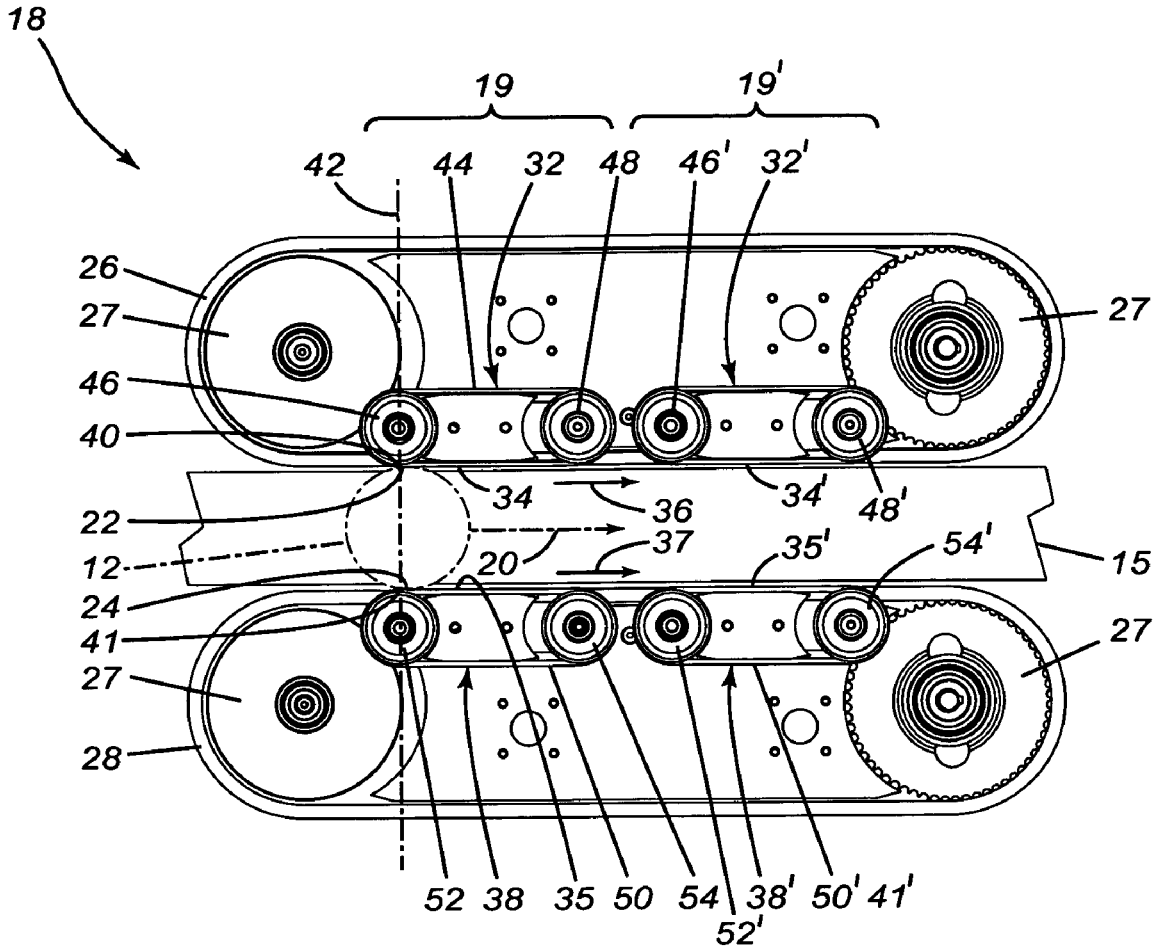
FIG. 3B, in a partial top plan view, illustrates the driven stage of the cap screwing assembly of FIG. 1, the driven stage engaging a container and a cap.
Figure 3C:
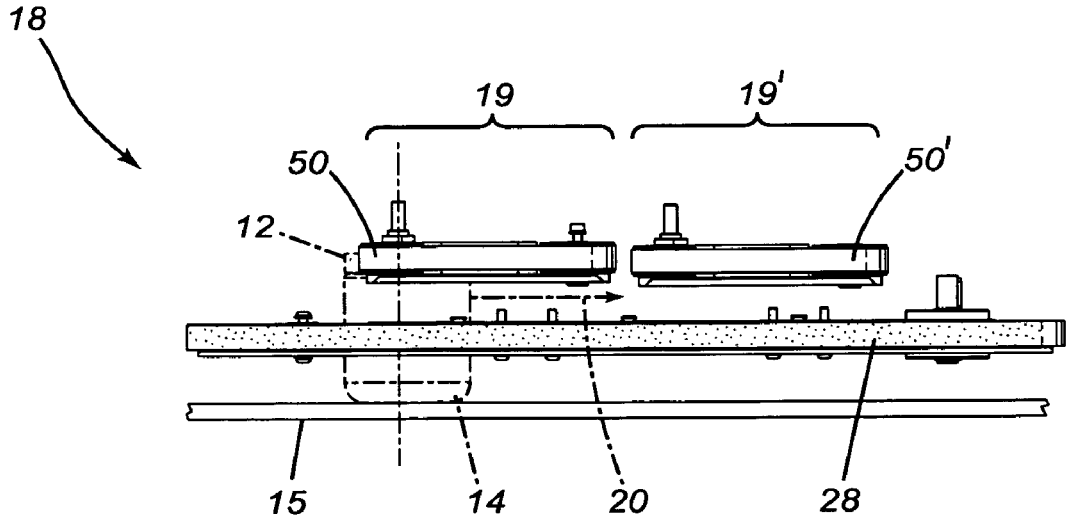
FIG. 3C, in a partial side elevation view, illustrates the driven stage of the apparatus of FIG. 1.

Referring to FIGS. 3A, 3B, 3C, a pair of container moving belt 26 and 28, move the container 14 in a substantially rectilinear path at the container speed 20 (not shown in FIG. 3A). The container moving belts 26 and 28 are mounted to pulleys 27 (seen in FIG. 3B) and move at substantially equal speeds.

The driven stage 18 includes a first cap rotating station 19 and a second cap rotating station 19'. The first cap rotating station 19 and the second cap rotating station 19' sequentially engage the cap 12 and apply forces onto the cap 12 to rotate the cap 12 relatively to the container 14.

Referring to FIG. 3B, the first cap rotating station 19 includes a first cap engaging component 32. The first cap engaging component 32 includes a first component cap engaging surface 34 for engaging the cap 12 at the first cap engagement location 22 and applying a first substantially tangential force thereto. The first cap engaging surface 34 moves at the first speed, indicated by the arrow denoted by the reference numeral 36. The first speed 36 is a speed at which the first component cap engaging surface 34 moves when the first cap engaging surface 34 is substantially in register with the first cap engagement location 22.

Similarly, a second cap engaging component 38 includes a second component cap engaging surface 35, for engaging the cap 12 at the second cap engagement location 24 and applying a second substantially tangential force thereto. The second cap engaging surface 35 moves at a second speed when substantially in register with the second cap engagement location, as indicated by the arrow 37.

The first and second cap engaging components 32 and 38 are operatively coupled to each other for maintaining substantially constant the sum of the first and second speeds 36 and 37. In some embodiments of the invention, the first and second cap engaging surfaces 34 and 35 are located on opposite sides of the predetermined path. However, it is within the scope of the invention to locate the first and second cap engaging surfaces 34 and 35 at any other suitable location.

The first and second cap engaging surfaces 34 and 35 define respectively a first and a second cap contacting location 40 and 41. The first and second cap contacting locations 40 and 41 define a lateral plane 42, the lateral plane being substantially perpendicular to the first and second tangential forces and to the predetermined path.

In some embodiments of the invention, the first cap engaging component 32 includes a first belt 44 mounted to both a first belt first pulley 46 and a first belt second pulley 48. The first belt 44 defines the first component engaging surface 34.

Similarly, the second engaging component 38 includes a second belt 50 mounted to both a second belt first pulley 52 and a second belt second pulley 54, the second belt 50 including the second component engaging surface 35. In some embodiments of the invention, as shown in FIG. 3B, the first and second belts 44 and 50 are each, at least in part, parallel to the predetermined path.

While the apparatus 10 includes a second cap rotating station 19', in alternative embodiments of the invention, only the first cap rotating station 19 is present. In yet other embodiments of the invention, more than two cap rotating stations are present in an apparatus similar to the apparatus 10.

The second cap rotating station 19' is substantially similar to the first cap rotating station and will therefore not be described in further details. In the drawings, reference numerals related to the second cap rotating station 19' and designating similar components are the same as the reference numerals designating the components of the first cap rotating station with a appended.

In some embodiments of the invention, the first cap rotating station 19 is used to rotate the cap 12 at a relatively large speed and the second cap rotating station 19' is used to apply a predetermined torque to the cap 12. However, in alternative embodiments of the invention, the cap rotating stations 19 and 19' are used in any other suitable manner.

As shown in FIG. 2, the driving and driven stages 16 and 18 are interconnected to allow the belts 44 and 50, the belts 44' and 50', and the container moving belts 26 and 28 to be moved pair wise relatively to each other so as to vary a spacing therebetween. This allows using the apparatus 10 with containers 14 and caps 12 having different dimensions. For example, for the first cap rotating station 19, a distance between the first and second cap engaging surfaces 34 and 35 is selectively adjustable between a first inter-engaging component distance and a second inter-engaging component distance larger than the first inter-engaging component distance. The belts 44 and 50, the belts 44' and 50', and the container moving belts 26 and 28 are interconnected to be able to be moved relative to each other in a conventional manner. The reader skilled in the art will readily appreciate that in other embodiments of the invention, the belts 44 and 50, the belts 44' and 50', the container moving belts 26 and 28, or any combination thereof are not movable relatively to each other so as to vary a spacing therebetween.

Referring to FIG. 2, the driving stage 16 includes a support plate 58 to which driving components are secured. The driving stage 16 includes a motor 60 that is connected to axles that drive the belts 44 and 50, the belts 44' and 50', and the container moving belts 26 and 28 as described hereinbelow.

The driving stage 16 includes first and second differentials 62 and 64. The differentials 62 and 64 are devices that each has an input and two outputs. When the input is rotated at a predetermined rotational speed, the two outputs are driven such that the sum of the rotational speeds of the two outputs is equal to twice the predetermined speed. The exact rotational speed of the two outputs depends on torques resisting the rotation of the two outputs. Differentials are well known in the art and the differentials 62 and 64 are therefore not described in further details herein.

Also, the driving stage 16 includes first and second brakes 66 and 68. The brakes 66 and 68 may be applied to create a frictional force between two rotating components of the apparatus 10. Typically, this frictional force is adjustable to allow the rotating components of the apparatus 10 to rotate at the same angular speed if a torque exerted on these two components is below a predetermined torque. If the torque is larger than the predetermined torque, these two components rotate with different angular speeds as two surfaces in the brakes slip relatively to each other.

Figure 4:
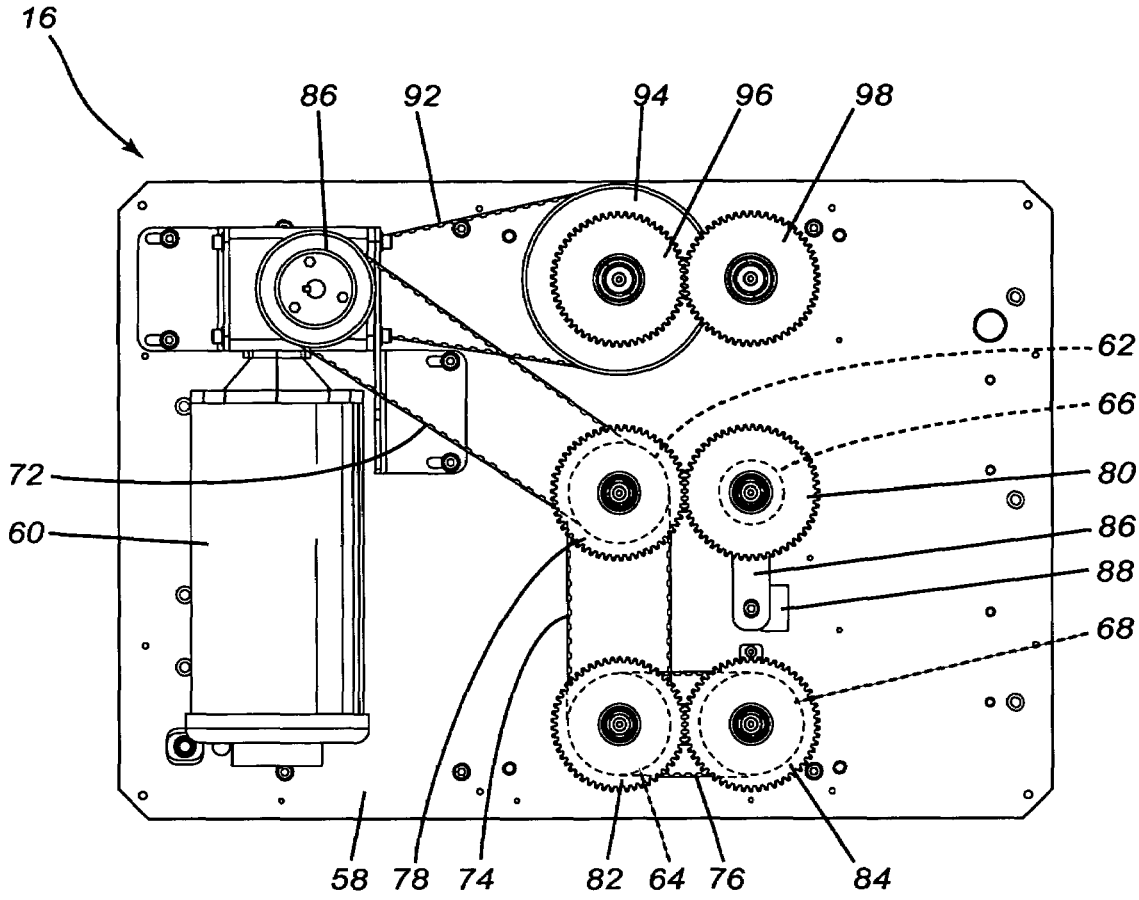
FIG. 4, in a top plan view, illustrates the driving stage of the apparatus of FIG. 1.

As more clearly seen in FIG. 4, the motor 60 drives a pulley 86 that drives the input of the first differential 62 through a belt 72. In turn, the input of the first differential 62 also drives the input of the differential 64 through a belt 74. The outputs of the first differential 62 are connected to a first gear 78 and to the pulley 46' that drives the first belt 34' of the second cap rotating station 19' (not seen in FIG. 4). Similarly, the outputs of the second differential 64 are connected to a second gear 82 and to the pulley 46 that drives first belt 44 of the first cap rotating station 19 (not seen in FIG. 4). The first gear 78 engages a third gear 80 that drives the second belt 35' of the second cap rotating station 19' (not seen in FIG. 4).

The first brake 66 is configured such that when the first brake 66 is engaged, a force is exerted against a movement of the second belt 35' of the second cap rotating station 19'. To that effect, the first brake 66 is coupled to an arm 86 that is itself coupled to a load cell 88. The load cell 88 is not necessarily present in all embodiments of the invention and may be replaced, for example, by a member extending from the plate 58. When present, the load cell 88 allows measuring a torque exerted onto the brake 66. When the first brake 66 is not engaged, the second belt 35' of the second cap rotating station 19' is driven directly by the output of the first differential 62 that is coupled to the first gear 78.

A fourth gear 84 engages the second gear 82. This second gear 84 is connected to the second belt 50 of the first cap rotating station 19 (not seen in FIG. 4). A belt 76 connects the input of the second differential 64 to the second brake 68. When the second brake 68 is engaged, the input of the second differential 64 and the output of the second differential 64 that connects to the second gear 82 are locked. This causes the second belt 50 of the first cap rotating station 19 to be driven by the motor 60. When the second brake 68 is not engaged, the output of the second differential 64 that connects to the second gear 82 drives the second belt 50 of the first cap rotating station 19 without interference from the input of the second differential 64.

The motor 60 also drives another output gear (not shown in the drawings) that is linked through a belt 92 to another pulley 94. The pulley 94 drives the container moving belt 26 at a predetermined speed directly through the pulley 94. Also, a fifth gear 96 rotates at the same rotational speed as the pulley 94. This fifth gear engages a sixth gear 98 that drives the container moving belt 28.

The gears 78, 80, 82, 84, 96 and 98 are linked to their respective pulleys 48', 54', 48, 54 and 27 that drive their respect belts 44', 50', 44, 50, 26 and 28 through universal joints 100 (better shown in FIG. 3A). The universal joints 100 allow to vary pair wise a spacing between the belts 26 and 28, 44 and 50, and 44' and 50' while keeping constant the positions of the driving components.

In some embodiments of the invention, the differentials 62 and 64, as well as the gears 78, 80, 82 and 84 are selected such that the sum of the first and second speeds 36 and 37 is about twice the container speed 20. However, in alternative embodiments of the invention, this sum is any other suitable sum.

Also, while the first and second cap rotating stations 19 and 19' in the device 10 are such that they have the same sum of their respective first and second speeds 36, 37 and 36', 37', it is within the scope of the invention to have the sum of the first and second speeds 36, 37 and 36', 37' of the first and second cap rotating stations 19 and 19' differ from each other.

The load cell 88 is provided for measuring the torque applied onto the first brake 66. This torque depends on the torque applied by the belts 44' and 50' of the second cap rotating station 19' to the cap 12. The reader skilled in the art will readily appreciate how to compute from a force measurement at the load cell 88 the torque applied on the cap 12.

The brakes 66 and 68 are able to apply a variable load to the cap engaging components. Adjustment of this load allows selecting of the torque to which the cap 12 is to be screwed. More specifically, the maximal torque exerted on the cap is about equal to the torque exerted by the brakes 66 and 68 multiplied by a factor that depends on the diameters of the components that connect the brakes 66 and 68 to the belts 44', 50' and 44, 50. Such factors depend on the exact configuration of the apparatus 10 and are readily computed by the reader skilled in the art.

Indeed, when for example the torque exerted on the cap 12 reaches a predetermined torque, the brake 66 starts to slip and the first differential 62 causes the belts 44' and 50' to move at the same speed. In turn, this stops the rotation of the 12 relatively to the container 14.

In alternative embodiments of the invention, not shown in the drawings, a cap torque controller is coupled to the load cell 88 for receiving a measurement of the torque exerted onto the cap 12. The cap torque controller is operatively coupled to the brake 66 for substantially eliminating the load applied by the brake 66 when the magnitude of the torque exerted onto the cap 12 reaches a predetermined magnitude.

In use, the container 14 is moved by being engaged by the container moving belts 26 and 28. These belts move at the same speed in opposite rotation directions, which makes them have the same container speed 20 at the locations wherein the container 14 is engaged. The gears 96 and 98 ensure that the first and second belts 26 and 28 rotate in opposite directions with substantially equal rotations speeds.

Figures 5A, 5B, 5C:
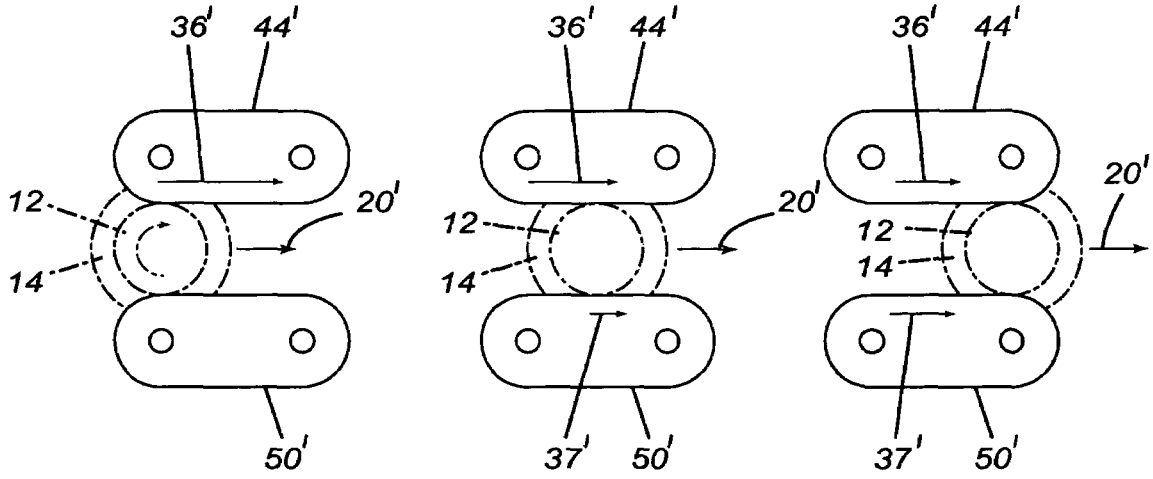
FIG. 5A, in a schematic view, illustrates a first step in the operation of the apparatus of FIG. 1 in accordance with an embodiment of the present invention.
FIG. 5B, in a schematic view, illustrates a second step in the operation of the apparatus of FIG. 1.
FIG. 5C, in a schematic view, illustrates a third step in the operation of the apparatus of FIG. 1.

FIGS. 5A, 5B and 5C illustrate schematically the operation of the second cap rotating station 19'. In these Figures, the first brake 66 is engaged to apply a predetermined load to the second belt 50'. Also, the cap 12 and the container 14 are illustrated as having different diameters for clarity reasons.

As shown in FIG. 5A, initially the cap 12 is only partially screwed onto the container 14 and therefore applies no, or a relatively small, torque to the second belt 50'. In this configuration, the first differential 62 ensures that the first speed 36' equal to about twice the container speed 20' and that the second speed 37' is equal to about 0.

This produces a relatively fast rotation of the cap 12 relatively to the container 14. Subsequently, as the cap 12 is further screwed onto the container 14, the cap encounters a resistance to its rotation caused by its engagement to the container 14. This causes the second speed 37' to increase while the first speed 36' decreases, as shown in FIG. 5B.

Finally, as seen in FIG. 5C, the force exerted by the cap 12 onto the belts 44' and 50' reaches a value such that the first brake 66 slips. The first differential 62 then causes the first and second speeds 36' and 37' to be substantially equal to each other and substantially equal to the container speed 20. Since the belts 44' and 50' rotate in opposing directions, but are facing each other, the point of contact between the cap 12 and the belt 44' and 50' move at the same speed, in the same direction.

Suitably selecting the value of the force exerted by the cap 12 onto the belts 44' and 50' that causes the first brake 66 to slip allows to screw the cap 12 onto the container 14 at a predetermined torque.

In the first cap rotating station 19, the input of the second differential 64 is coupled to the second brake 68. When the second brake 68 is not engaged, the second brake 68 rotates relatively to the second belt first pulley 52. In this case, the second differential 64 causes the first and second speeds 36 and 37 to be substantially identical.

Figure 6A:
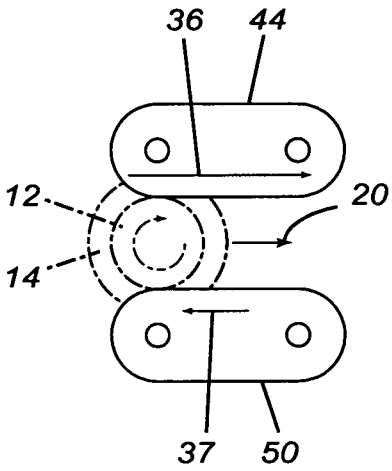
FIG. 6A, in a schematic view, illustrates a first step in the operation of the apparatus of FIG. 1 in accordance with another embodiment of the present invention.
Figure 6B:
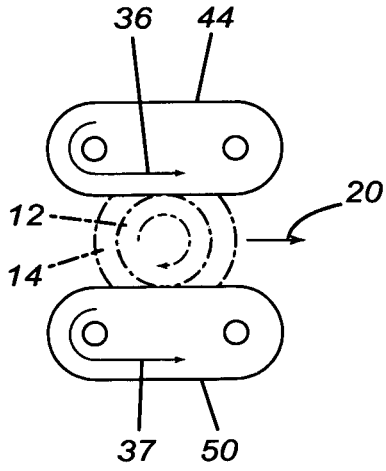
FIG. 6B, in a schematic view, illustrates a second step in the operation of the apparatus of FIG. 1.
Figure 6C:
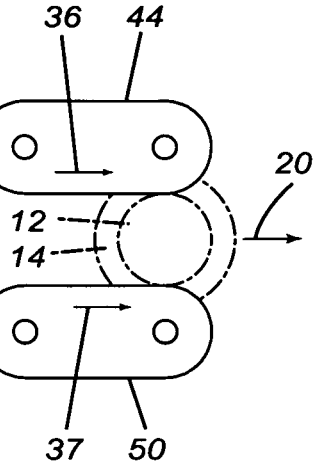
FIG. 6C, in a schematic view, illustrates a third step in the operation of the apparatus of FIG. 1.

When the brake 68 is engaged, the apparatus 10 operates as seen in FIGS. 6A to 6C. Initially, as illustrated in FIG. 6A, the cap 12 is only partially screwed onto the container 14 and therefore applies no, or a relatively small, torque to the second belt first pulley 52. The second belt first pulley 52 is driven by the motor 60 and forces the second speed 37 to take a predetermined value. For example, the second speed 37 is oriented in a direction opposite to the orientation of the container speed 20. In turn, the second differential 64 then causes the first speed 36 to be more than two times larger than the container speed 20. In this mode, a relatively fast rotation of the cap 12 occurs onto the bottle 14. This allows the use of belts 44' and 50' that are relatively short, which in turn helps in minimizing the size of the apparatus 10.

As the cap 12 is screwed, the cap 12 begins to resist the screwing motion. However, since the second belt 50 is driven by the motor 60, the first and second speeds do not change, as seen in FIG. 6B.

In some embodiments of the invention, as seen in FIG. 6C, the force exerted by the cap 12 onto the belts 44 and 50 reaches a value such that the second brake 68 slips. The second differential 64 then causes the first and second speeds 36 and 37 to be substantially equal to each other and substantially equal to the container speed 20. Since the belts 44 and 50 rotate in opposing directions, but are facing each other, the points of contact between the cap 12 and the belt 44 and 50 move at the same speed, in the same direction.

In other embodiments of the invention, the force exerted by the cap 12 onto the belts 44 and 50 never reaches a value such that the second brake 68 slips. In these embodiments, the situation illustrated in FIG. 6C does not occur.

In some embodiments of the invention, as seen in the drawings, the sum of the first and second speeds is maintained by having the differentials 62 and 64 interconnecting first and second cap engaging components. In other embodiments of the invention, not shown in the drawings this relationship is maintained with the use of speed measuring devices and motors that are interconnected with the controller that maintain the above-mentioned relationship.

Also, while the belts shown in the drawings are toothed belts, it is also within the scope of the invention to use smooth belts when the forces exerted onto these belts allow doing so. Furthermore, in some embodiments of the invention some belts and pulleys may be replaced by chains and sprocket wheels or any other suitable devices having a similar function.

Figure 7:
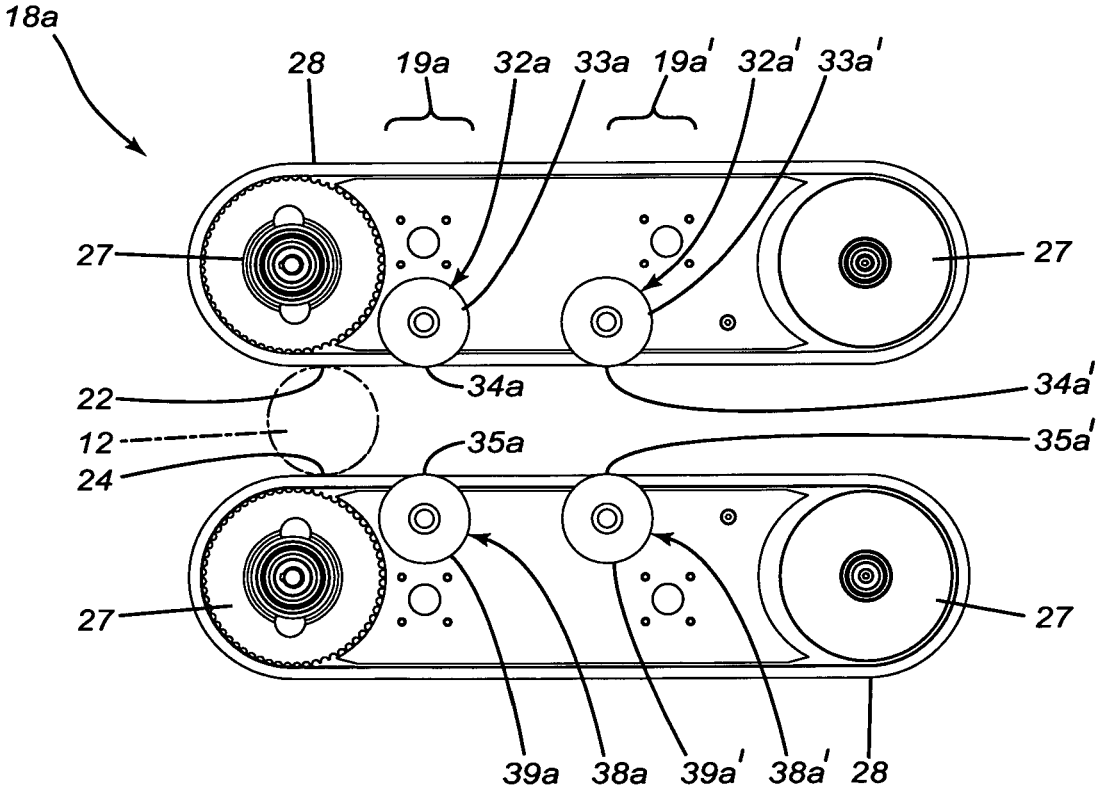
FIG. 7, in a top plan view, illustrates a driven stage of an apparatus for rotating a cap relatively to a container in accordance with another embodiment of the present invention.

FIG. 7 illustrates an alternative embodiment of the invention wherein the belts and pulleys of the first and second cap rotating stations are absent. Instead, an alternative apparatus includes an alternative driven stage 18*a*. The driven stage 18*a* is similar to the driven stage 18 except that the driven stage 18*a* includes a first cap rotating station 19*a* and a second cap rotating station 19*a'*.

The first cap rotating station 19*a* includes first and second cap engaging components 32*a* and 38*a* that are substantially disc-shaped and include respectively a first and a second peripheral surface 33*a* and 39*a*. First and second cap engaging surfaces are formed respectively by the first and second peripheral surfaces 33*a* and 38*a*.

The second cap rotating station 19*a*' is similar to the first cap rotating station 19*a* and will therefore not be further described. The components of the second cap rotating station 19*a*' are denoted by the same reference numerals as corresponding components of the first cap rotating station 19*a* to which a has been appended.

The driven stage 18*a* functions similarly to the driven stage 18. However, the duration of a contact between cap engaging surfaces and the cap 12 in the driven stage 18*a* are typically smaller than the duration of the contact between cap engaging surfaces and the cap 12 in the driven stage 18.

Although the present invention has been described hereinabove by way of preferred embodiments thereof, it can be modified, without departing from the spirit and nature of the subject invention as defined in the appended claims.

What is claimed is:

1. An apparatus for rotating a cap relatively to a container, the container moving along a predetermined path at a container speed, the cap having a first and a second cap engagement location, the first and second cap engagement locations being circumferentially spaced apart relatively to each other, said apparatus comprising:

a first cap engaging component, the first cap engaging component including a first component cap engaging surface for engaging the cap at the first cap engagement location and applying a first substantially tangential force thereto, the first cap engaging surface moving at a first speed when substantially in register with said first cap engagement location;

a second cap engaging component, the second cap engaging component including a second component cap engaging surface for engaging the cap at the second cap engagement location and applying a second substantially tangential force thereto, the second cap engaging surface moving at a second speed when substantially in register with said second cap engagement location; and a differential operatively coupled to said first and second cap engaging components in a manner such that said differential maintains substantially constant a sum of said first and second speeds.

2. An apparatus as defined in claim 1, wherein said first and second cap engagement locations are substantially diametrically opposed relatively to each other.

3. An apparatus as defined in claim 2, wherein said first and second cap engaging surfaces are located on opposite sides of the predetermined path.

4. An apparatus as defined in claim 3, wherein the cap rotates about a cap rotation axis, said first and second cap engaging surfaces defining respectively a first and a second engagement surface cap contacting location, said first and second engagement surface cap contacting locations defining a lateral plane, said lateral plane being substantially perpendicular to said first and second tangential forces and to the predetermined path.

5. An apparatus as defined in claim 4, wherein said sum of said first and second speeds is about twice the container speed.

6. An apparatus as defined in claim 5, wherein said first and second cap engaging components are substantially disc-shaped and include respectively a first and a second peripheral surface, said first and second peripheral surfaces including respectively said first and second cap engaging surfaces.

7. An apparatus as defined in claim 5, wherein said first engaging component includes a first belt mounted to both a first belt first pulley and a first belt second pulley, said first belt including said first component engaging surface; and said second engaging component includes a second belt mounted to both a second belt first pulley and a second belt second pulley, said second belt including said second component engaging surface.

8. An apparatus as defined in claim 7, wherein said first and second belts are each at least in part parallel to the predetermined path.

9. An apparatus as defined in claim 1, further comprising a brake operatively coupled to said first cap engaging component for applying a load to said first cap engaging component.

10. An apparatus as defined in claim 9, wherein said brake is adjustable for applying a variable load to said first cap engaging component.

11. An apparatus as defined in claim 10, further comprising a force sensor for measuring a magnitude of said first tangential force.

12. An apparatus as defined in claim 9, wherein said brake causes said first tangential speed to be about zero when said first tangential force is zero.

13. An apparatus as defined in claim 12, wherein said first cap engaging component is operatively coupled to said second cap engaging component and to said brake to cause said first tangential speed to increase when said first tangential force increases.

14. An apparatus as defined in claim 1, further comprising a motor driving said first cap engagement component such that said first speed is a predetermined speed.

15. An apparatus as defined in claim 1, wherein said first and second cap engaging components are movable relatively to each other such that a distance between said first and second cap engaging surfaces is selectively adjustable.

* * * * *